US006619658B2

(12) United States Patent
Shiau

(10) Patent No.: US 6,619,658 B2
(45) Date of Patent: Sep. 16, 2003

(54) MEDIA-CONVEYING APPARATUS IN PRINTER

(75) Inventor: Ching-Shin Shiau, Tai-Nan Hsien (TW)

(73) Assignee: BenQ Corporation, Tao-Yuan Hsien (TW)

( * ) Notice: Subject to any disclaimer, the term of this patent is extended or adjusted under 35 U.S.C. 154(b) by 0 days.

(21) Appl. No.: 09/683,363

(22) Filed: Dec. 18, 2001

(65) Prior Publication Data

US 2002/0084580 A1 Jul. 4, 2002

(30) Foreign Application Priority Data

Dec. 29, 2000 (TW) ..... 89128205 A

(51) Int. Cl.[7] ..... B65H 5/02
(52) U.S. Cl. ..... 271/274
(58) Field of Search ..... 271/274

(56) References Cited

U.S. PATENT DOCUMENTS 4,775,142 A * 10/1988 Silverberg ..... 271/274 X
4,997,179 A * 3/1991 Mizutani et al. ..... 271/274 X
5,606,357 A * 2/1997 Bekki ..... 271/274 X
5,954,327 A 9/1999 Lin et al.
5,988,635 A * 11/1999 Ohshima ..... 271/274
6,336,629 B1 * 1/2002 Carter et al. ..... 271/274

FOREIGN PATENT DOCUMENTS

| | | | |
|---|---|---|---|
| EP | 0 472 893 A1 | * | 3/1992 |
| JP | 58008679 A | | 1/1983 |
| JP | 01291966 A | | 11/1989 |
| JP | 05000542 A | | 1/1993 |
| JP | 6-64774 A | * | 8/1994 |
| JP | 11170641 A | | 6/1999 |

* cited by examiner

*Primary Examiner*—David H. Bollinger
(74) *Attorney, Agent, or Firm*—Winston Hsu

(57) ABSTRACT

A media-conveying apparatus in a printing machine is used to convey a printing media. The media-conveying apparatus has a support, a star-wheel having a plurality of tips around its edge, an axle set at a center of the star-wheel and a monolithic elastic apparatus. The elastic apparatus has a first torsion arm and a second torsion arm. The first torsion arm is placed on the support. The second torsion arm presses the axle so the tips of the star-wheel elastically contact the printing media.

14 Claims, 8 Drawing Sheets

MEDIA-CONVEYING APPARATUS IN PRINTER

BACKGROUND OF INVENTION

1. Field of the Invention

The invention relates to a media-conveying apparatus, and more particularly, to a media-conveying apparatus in a printer.

2. Description of the Prior Art

Printers are used to print information on a media (such as paper). Printers usually have a media-conveying apparatus to convey the media and make printers capable of printing on different areas of the media. Most media-conveying apparatuses use rollers to drive the media. But for some printers, such as inkjet printers, print by applying liquid dye to the media. To avoid staining the rollers with liquid dye while the media is being driven, the printing apparatus usually uses star-wheels, or called spurs. The star-wheel has a plurality of tips around an edge and uses the tips to contact to the printed media. Since the contact area between a tip and the printing media is quite small, printing quality is not reduced if attached dye is still wet. In addition, for the media-conveying apparatus to use printing media of different thicknesses, a printing apparatus of the prior art has an elastic apparatus for elastically pressing on the star-wheel so the star-wheel can move vertically according to the printing media thickness when the media-conveying apparatus is conveying printing media.

Please refer to FIGS. 1 and 2. FIG. 1 is a schematic diagram of a media-conveying apparatus 20 of the prior art used in a printing machine 10. FIG. 2 is a cross-sectional diagram of a media-conveying apparatus 20 of FIG. 1 along line 2—2. The media-conveying apparatus 20 is used in printer 10 to convey a printing media 28. The media-conveying apparatus 20 has a support 46 for placement of other parts of media-conveying apparatus 20, a rotational arm 24 rotating around a fixed support point 36, a spring 26 with one end fixed on support 46 for elastically pressing a first arm 32 of rotational arm 24, a star-wheel 22 having a plurality of tips 38 around its circular edge and a roller 42 below star-wheel 22 to drive printing media 28. Rotational arm 24 further has a second arm 34. Star-wheel 22 is rotatable and is set on an axle that is placed on second arm 34.

When roller 42 is driving printing media 28, because the spring 26 elastically presses the first arm 32 of rotational arm 24, the printing media 28 is nipped between star-wheel 22 and roller 42, and tips 38 of star-wheel 22 elastically contact printing media 28. So star-wheel 22 can accommodate printing media 28 of different thicknesses due to spring 26.

Please refer to FIG. 3 of a cross-sectional diagram of a media-conveying apparatus 50 of another prior art. The media-conveying apparatus 50 has a support 68 for placing other parts of the media-conveying apparatus 50, a cylinder 62 having a support point 64, a star-wheel 54 having a plurality of tips 56 around an edge, a spring 52 with one end fixed on support 68 for elastically pressing on arm 62 and a roller 58 below star-wheel 54 for driving printing media 66. Star-wheel 54 uses support point 64 as a center and is set on arm 62. When roller 58 is driving printing media 66, spring 52 elastically presses the arm 62, printing media 66 is nipped between the star-wheel 54 and the roller 58 and the tips 56 of star-wheel 54 elastically contact to printing media 66.

Printing apparatuses 20 and 50 of prior arts have a weakness in that spring 26 and 52 are fixed on supports making maintenance and replacement of springs 26 and 52 difficult. In addition, media-conveying apparatuses 20 and 50 of prior arts have more components and are manufactured manually in a complex assembly process.

SUMMARY OF THE INVENTION

It is therefore a primary objective of the present invention to provide a media-conveying apparatus to solve the above-mentioned problem.

Briefly, in a preferred embodiment, the present invention provides a media-conveying apparatus comprising:

a support;

a star-wheel having a plurality of tips around an edge;

a wheel axle through a center of the star-wheel; and a monolithic first elastic apparatus having a first torsion arm placed on the support and a second torsion arm for pressing the axle to make the tips of the star-wheel elastically contact a printing media.

It is an advantage of the present invention that the media-conveying apparatus according to the present invention has fewer parts and is easy to assemble and maintain.

These and other objects and the advantages of the present invention will no doubt become obvious to those of ordinary skill in the art after having read the following detailed description of the preferred embodiment that is illustrated in the various figures and drawings.

DETAILED DESCRIPTION

Figure 1:
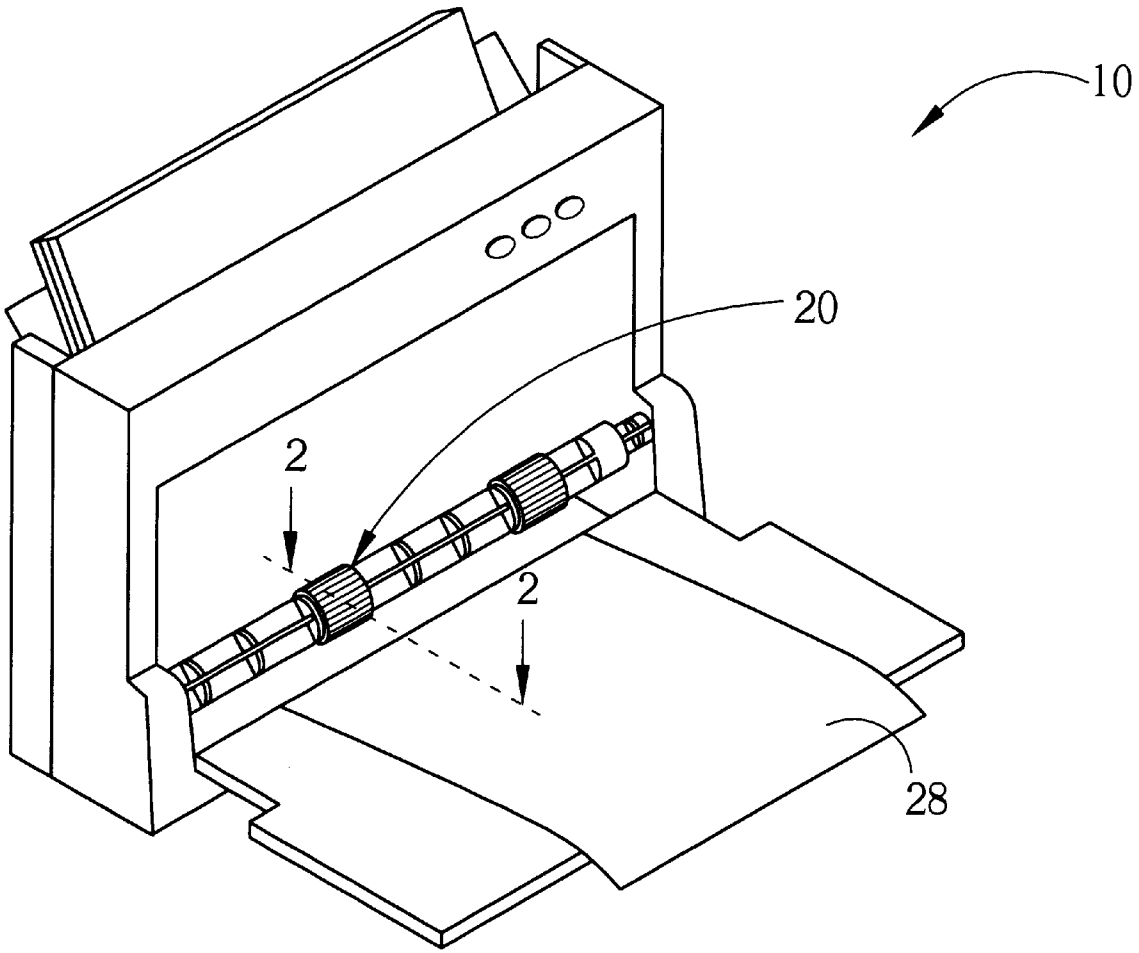
Fig. 1 Prior art
FIG. 1 is a schematic diagram of a media-conveying apparatus of the prior art in a printer.
Figure 2:
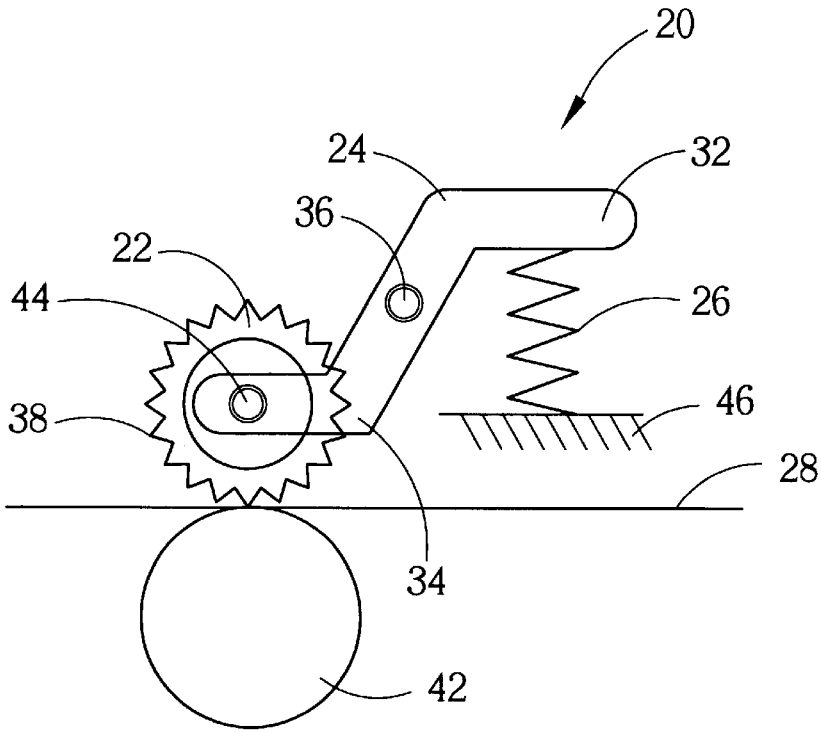
Fig. 2 Prior art
FIG. 2 is a cross-section diagram of a media-conveying apparatus along line 2—2.
Figure 3:
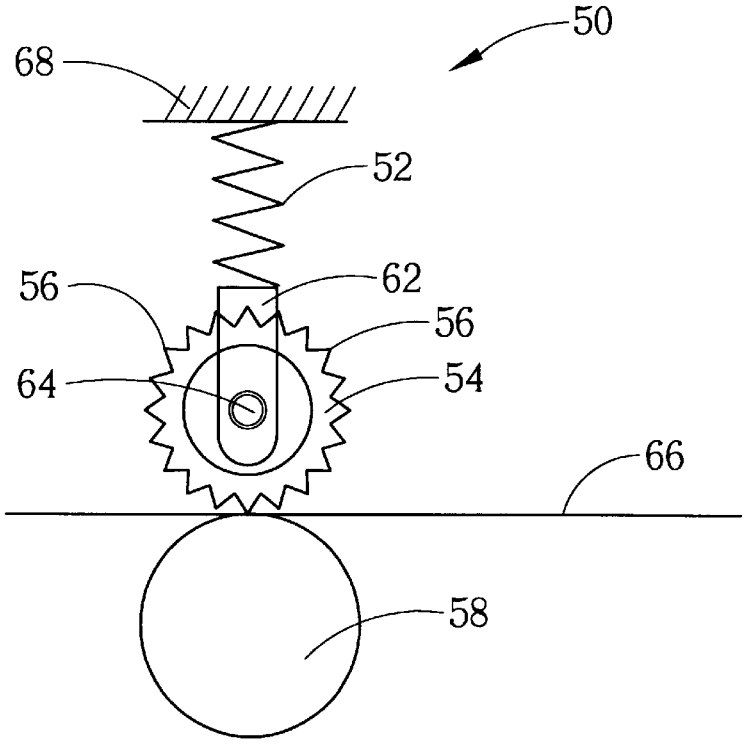
Fig. 3 Prior art
FIG. 3 is a cross-sectional diagram of another media-conveying apparatus.
Figure 4:
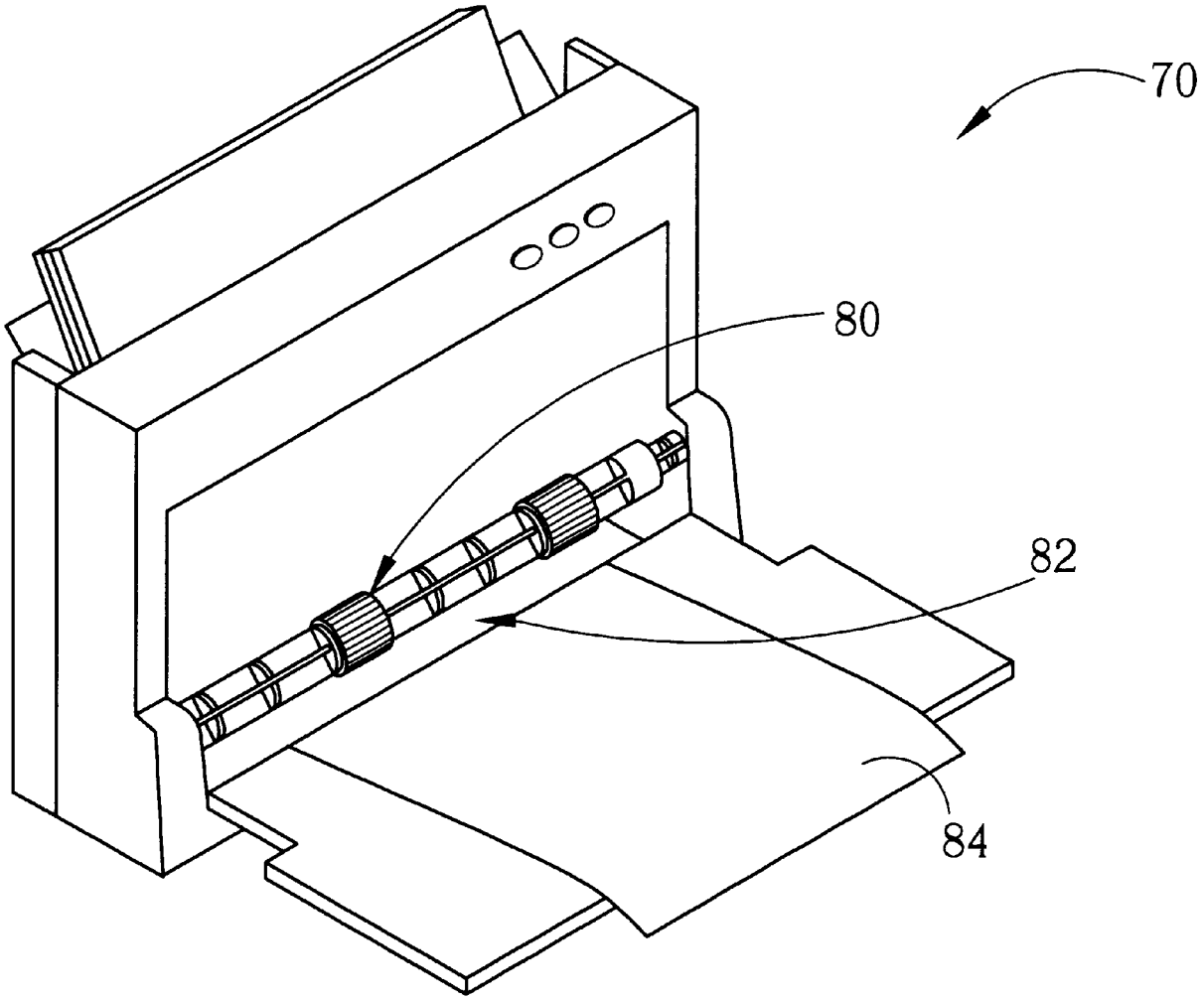
FIG. 4 is a schematic diagram of a media-conveying apparatus of a first embodiment of the present invention in a printing machine.
Figure 5:
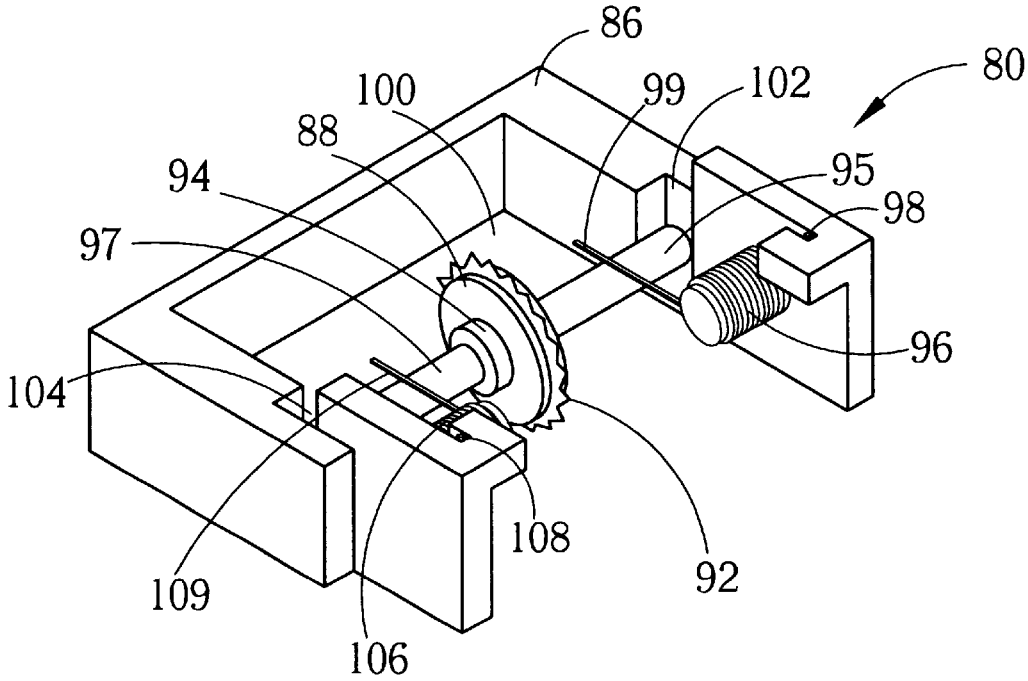
FIG. 5 is a schematic diagram of the media-conveying apparatus of FIG. 4.
Figure 6:
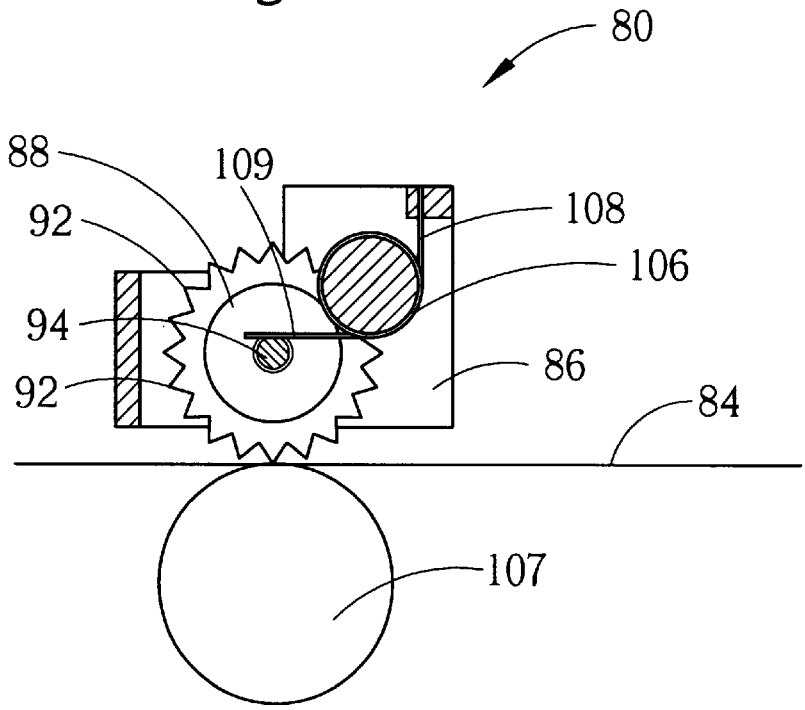
FIG. 6 is a side view of the media-conveying apparatus of FIG. 4.

Please refer to FIGS. 4 to 6. FIG. 4 is a schematic diagram of a media-conveying apparatus 80 of a first embodiment of the present invention used in a printing machine 70. FIG. 5 is a schematic diagram of the media-conveying apparatus 80 of FIG. 4. FIG. 6 is a side view of the media-conveying apparatus 80 of FIG. 4. Media-conveying apparatus 80 used to convey a printing media 84 comprises a support 86 for supporting other parts of media-conveying apparatus 80, a star-wheel 88 having a plurality of tips 92 around the edge, an axle 94 through a center of the star-wheel 88, a first elastic device 96, a second elastic device 106 and a roller 107 for driving printing media 84. The first elastic device 96 and the second elastic device 106 are torsion springs. Printing machine 70 has a paper outlet 82 for printing media 84 to be conveyed by media-conveying apparatus 80 to the outside.

Axle 94 has a first shaft 95 and a second shaft 97 respectively disposed on opposite sides of the star-wheel. Support 86 has a groove 100 for placing a first torsion spring 96 and a second torsion spring 106 on both sides of the inner wall. In addition, groove 100 has two notches 102 and 104 for accommodating a first shaft 95 and a second shaft 97 to restrict to perpendicular movement of star-wheel 88. First torsion spring 96 has a first torsion arm 98 and a second torsion arm 99. Second torsion spring 106 has a third torsion arm 108 and a fourth torsion arm 109. The opening angles between the two torsion arms of first torsion spring 96 and second torsion spring 106 are less after assembly than the free angles between the two torsion arms of first torsion spring 96 and second torsion spring 106 before assembly, so assembling into the inner wall of support 86 introduces an elastic force to press first shaft 95 and second shaft 97 of axle 94 and makes tips 92 of star-wheel 88 elastically contact printing media 84. After that, roller 107 drives printing media 84 to go out of printer 70 from outlet 82. Furthermore, media-conveying apparatus 80 is not necessary to use both the first torsion spring 96 and second torsion spring 106 at the same time and can use only second torsion arm 99 of first torsion spring 96 to press first shaft 95 to make tips 92 of star-wheel 88 elastically contact media 84.

Figure 7:
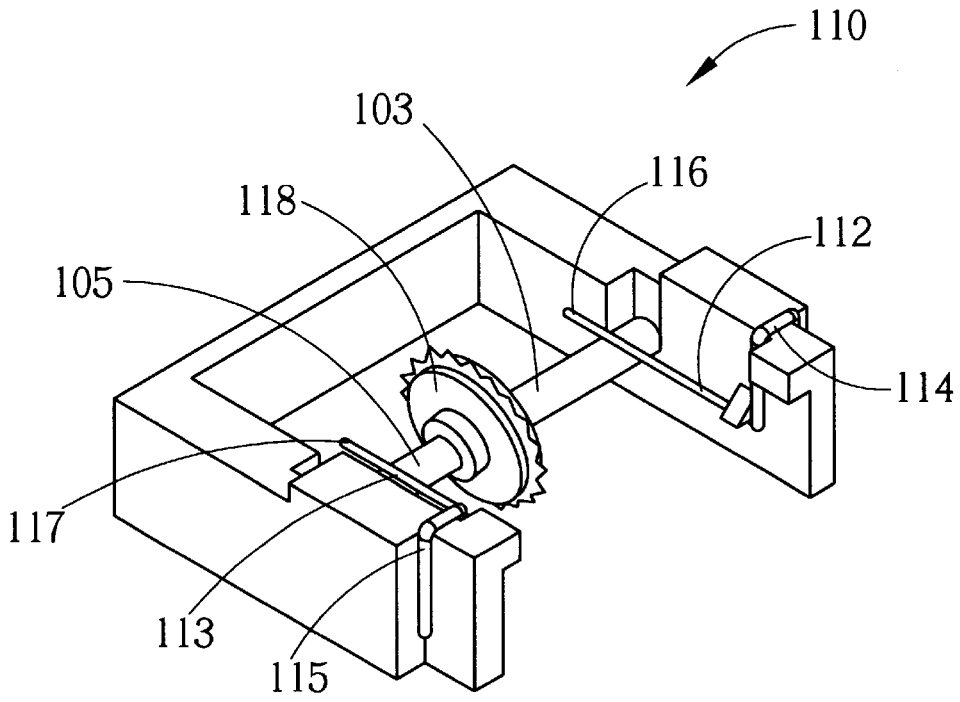
FIG. 7 is a schematic diagram of a media-conveying apparatus of a second embodiment of the present invention.
Figure 8:
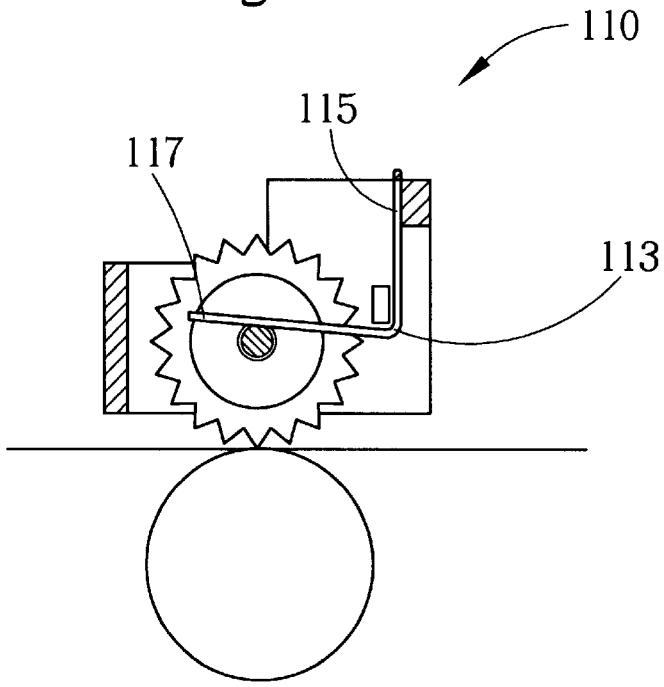
FIG. 8 is a side view of the media-conveying apparatus of FIG. 7.
Figure 9:
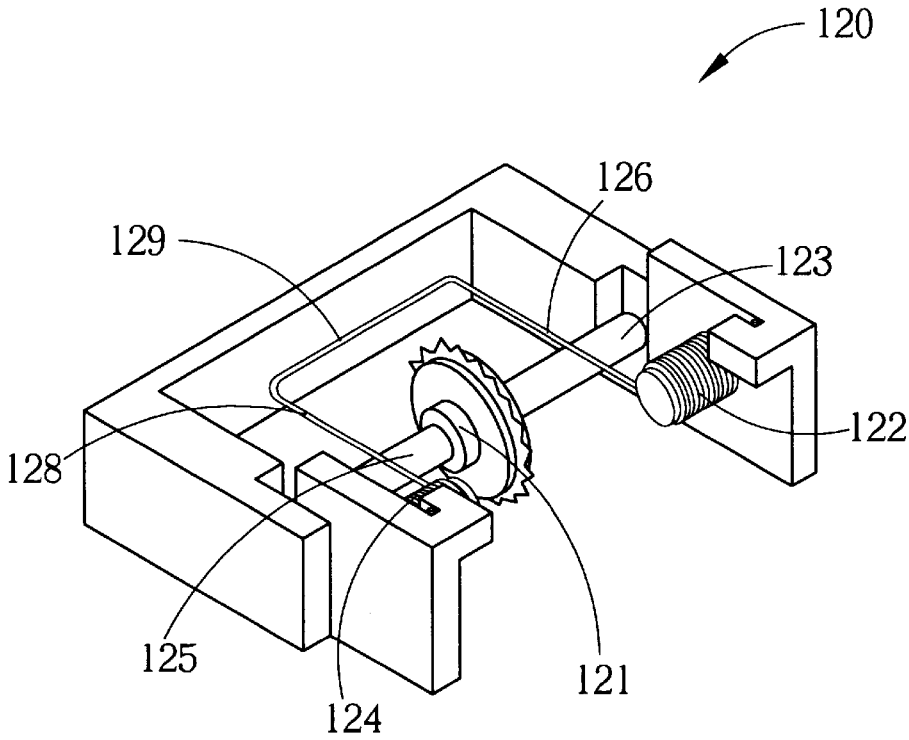
FIG. 9 is a schematic diagram of a media-conveying apparatus of a third embodiment of the present invention.
Figure 10:
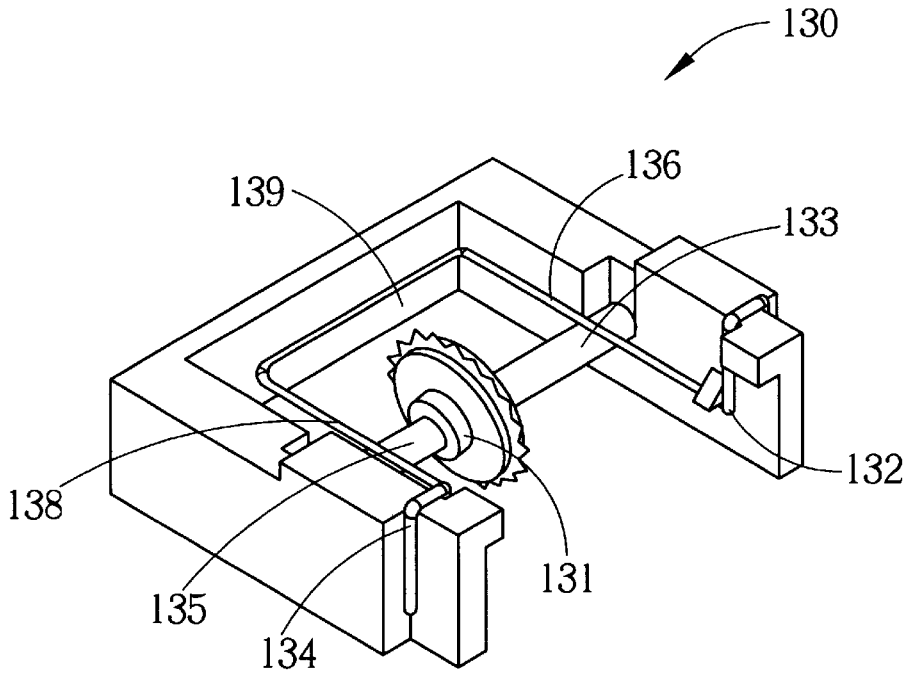
FIG. 10 is a schematic diagram of a media-conveying apparatus of a fourth embodiment of the present invention.

Please refer to FIGS. 7 and 8. FIG. 7 is a schematic diagram of a media-conveying apparatus 110 of a second embodiment of the present invention. FIG. 8 is a side view of a media-conveying apparatus 110 of FIG. 7. The difference in the second embodiment from the first embodiment is in the substitution of two torsion springs by two linear spring arms. A first elastic apparatus 112 and a second elastic apparatus 113 of media-conveying apparatus 110 are respectively replaced by a linear spring arm. First linear spring arm 112 has a first torsion arm 114 and a second torsion arm 116, second linear spring arm 113 has a third torsion arm 115 and a fourth torsion arm 117. During assembly, pressing two torsion arms of linear spring arms 112 and 113 produces an elastic force to press first shaft 103 and second shaft 105 of the axle and make tips of star-wheel 118 elastically contact the printing media. In this embodiment, one elastic apparatus (such as linear spring arm 112) also makes the tips of star-wheel 118 elastically contact the printing media. Please refer to FIGS. 9 and 10. FIG. 9 is a schematic diagram of a media-conveying apparatus 120 of a third embodiment of the present invention. FIG. 10 is a schematic diagram of a media-conveying apparatus 130 of a fourth embodiment of the present invention. Conveying apparatuses 120 and 130 respectively have axles 121 and 131, first elastic apparatuses 122 and 132 and second elastic apparatuses 124 and 134. Axles 121 and 131 respectively have first shafts 123 and 133 and second shafts 125 and 135. First elastic apparatuses 122 and 132 respectively have second torsion arms 126 and 136. Second elastic apparatuses 124 and 134 respectively have forth torsion arms 128 and 138. Second torsion arms 126 and 136 and forth torsion arms 128 and 138 are used to press first shafts 123 and 133 and second shafts 125 and 135 of axles 121 and 131. As shown in FIGS. 9 and 10, first elastic apparatuses 122 and 132 are connected to second elastic apparatuses 124 and 134 by arms 129 and 139 allowing for convenient assembly.

Figure 11:
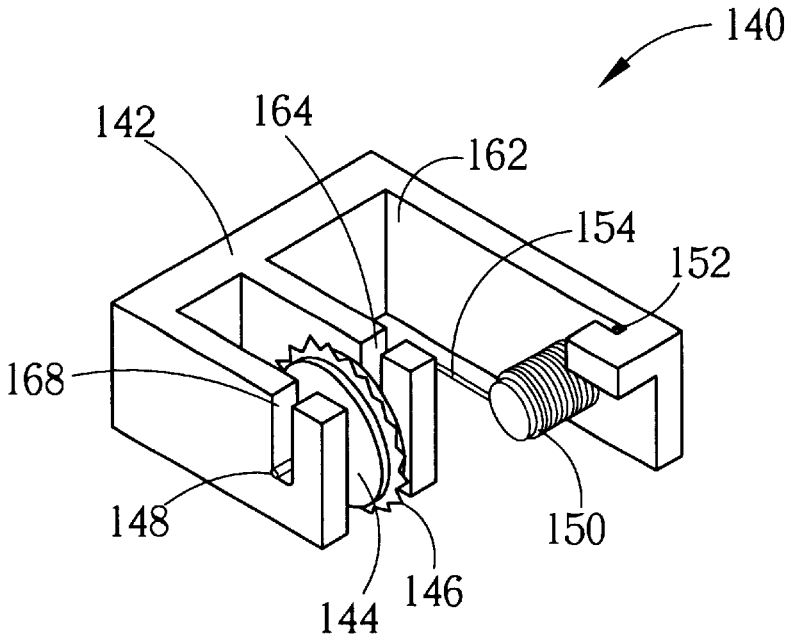
FIG. 11 is a schematic diagram of a media-conveying apparatus of a fifth embodiment of the present invention.
Figure 12:
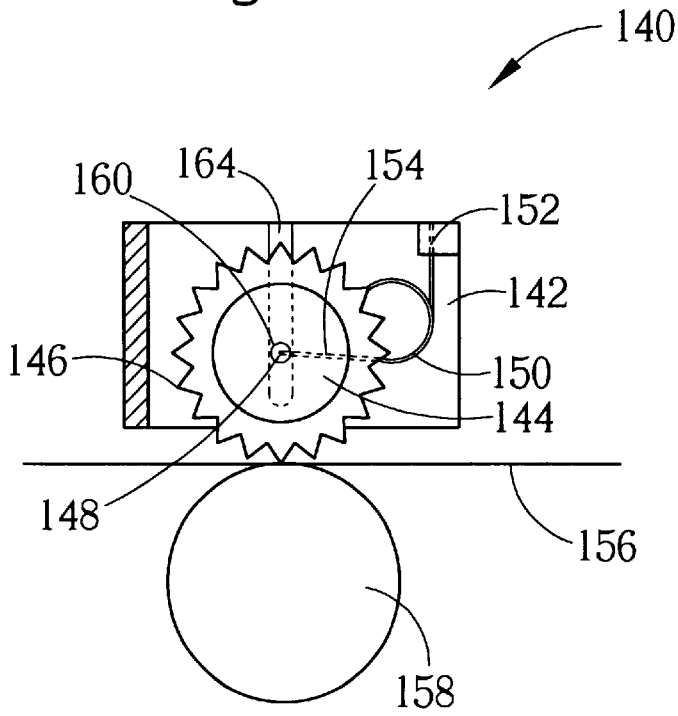
FIG. 12 is a side view of the media-conveying apparatus of FIG. 11.

Please refer to FIGS. 11 and 12. FIG. 11 is a schematic diagram of a media-conveying apparatus 140 of a fifth embodiment of the present invention. FIG. 12 is a side view of the media-conveying apparatus 140 of FIG. 11. Media-conveying apparatus 140 is used to convey a printing media 156. Media-conveying apparatus 140 has a support 142 for supporting other parts of media-conveying apparatus 140, a star-wheel 144 having a plurality of tips 146 around an edge, an axle 148 through a center of star-wheel 144, a first elastic apparatus 150 and a roller 158. Support 142 has a groove 162 for accommodating the first elastic apparatus 150. In addition, groove 162 has two notches 164 and 168 for accommodating both ends of axle 148 to restrict movement of axle 148 in a vertical direction.

First elastic apparatus 150 has a first torsion arm 152 and a second torsion arm 154. First torsion arm 152 is set on support 142. Second torsion arm 154 is set through the center 160 of star-wheel 144 and becomes axle 148 in the end and axle 148 is restricted in notches 164 and 168 so star-wheel 144 can rotate around axle 148. In addition, the opening angle between torsion arms 152 and 154 of first elastic apparatus 150 is smaller after assembly than the free angle before assembly so first elastic apparatus 150 presses on the center of star-wheel 144 and makes tips 146 of star-wheel 144 elastically contact printing media 156.

Figure 13:
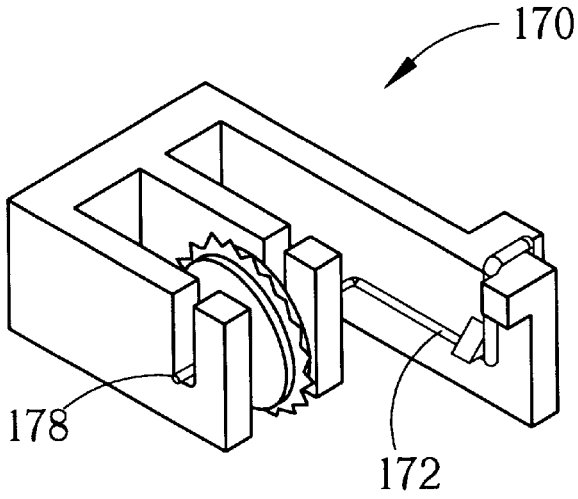
FIG. 13 is a schematic diagram of a sixth embodiment of the media-conveying apparatus of the present invention.
Figure 14:
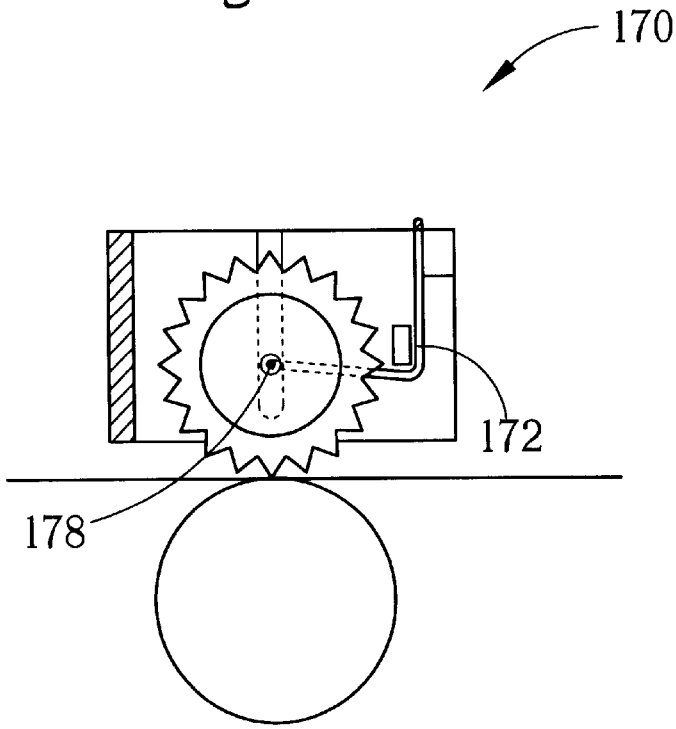
FIG. 14 is a side view of the media-conveying apparatus of FIG. 13.

Please refer to FIGS. 13 and 14. FIG. 13 is a schematic diagram of a sixth embodiment of a media-conveying apparatus 170 of the present invention. FIG. 14 is a side view of the media-conveying apparatus 170 of FIG. 13. Different from a torsion spring used in first elastic apparatus 150 of the fifth embodiment, the first elastic apparatus 172 used in this embodiment is a linear spring arm. First elastic apparatus 172 and axle 178 are monolithic and the center of star-wheel is elastically pressed by axle 178 and tips of the star-wheel elastically contact printing media.

In all above embodiments, pressure exerted on printing media by the star-wheel can be controlled by the opening angle of two elastic arms of a torsion spring or the diameter of the linear spring arm and assembly is simplified and space occupied by devices is shrunk.

Compared to media-conveying apparatus of the prior art, assembly procedures of the media-conveying apparatus of a printing machine of the present invention, as shown from FIG. 5 to FIG. 10, is to first put an axle in two notches to put a star-wheel in a support, followed by placing a first elastic apparatus on the support with the first elastic apparatus elastically pressing the axle; or as shown from FIG. 11 to FIG. 14, a first elastic apparatus is placed in a support and put an axle of the first elastic apparatus in a center of a star-wheel so the star-wheel is pressed by the first elastic apparatus in the center. So the present invention fixes the first elastic apparatus and the axle, then uses a second torsion arm of the first elastic apparatus to press the axle and make the tips of the star-wheel elastically contact the printing media. Therefore the media-conveying apparatus of the present invention is more easily assembled and maintained than ordinary media-conveying apparatuses.

Those skilled in the art will readily observe that numerous modifications and alterations of the propeller may be made while retaining the teachings of the invention. Accordingly, the above disclosure should be construed as limited only by the metes and bounds of appended claims.

What is claimed is:

1. A media-conveying apparatus in a printer, the media-conveying apparatus comprising:

a support;

a star-wheel having a plurality of tips around an edge of the star-wheel;

an axle through a center of the star-wheel; and a monolithic first elastic apparatus having a first torsion arm placed on the support and a second torsion arm for pressing the axle to make the tips of the star-wheel elastically contact a printing media.

2. The media-conveying apparatus of claim 1 wherein the axle has a first shaft and a second shaft respectively disposed on opposite sides of the star wheel, the second torsion arm pressing on the first shaft to cause the tips of the star-wheel to elastically contact the printing media.

3. The media-conveying apparatus of claim 2 further comprising a second monolithic elastic apparatus having a third torsion arm on the support and a fourth torsion arm pressing on the second shaft to cause the tips of the star-wheel to elastically contact the printing media.

4. The media-conveying apparatus of claim 3 wherein the second torsion arm and the fourth torsion arm are connected by an arm so that the first elastic apparatus and the second elastic apparatus form a monolithic structure.

5. The media-conveying apparatus of claim 3 wherein the support has a first notch and a second notch adapted to respectively fix the first torsion arm and third torsion arm, and a groove adapted to fit the axle so that the first shaft and the second shaft are capable of moving perpendicularly to the printing media.

6. The media-conveying apparatus of claim 1 wherein the first elastic apparatus is a torsion spring.

7. The media-conveying apparatus of claim 6 wherein force exerted by the star-wheel on the printing media changes with a free angle between the first torsion arm and the second torsion arm of the first torsion spring.

8. The media-conveying apparatus of claim 1 wherein the first elastic apparatus is a linear spring arm.

9. The media-conveying apparatus of claim 8 wherein force exerted by the star-wheel on the printing media changes with a wire diameter of the linear spring arm.

10. The media-conveying apparatus of claim 1 wherein the axle and the first elastic apparatus are monolithic, the star-wheel having a hole through which the axle penetrates, the star-wheel rotating around the axle and pressed by the first elastic apparatus to cause the tips of the star-wheel to elastically contact the printing media.

11. The media-conveying apparatus of claim 10 wherein the support has a groove to fix the first elastic apparatus, and two notches in which the two ends of the axle are respectively disposed, the two notches enabling the axle to move perpendicularly to the printing media through a limited range.

12. The media-conveying apparatus of claim 10 wherein the first elastic apparatus is a torsion spring.

13. The media-conveying apparatus of claim 10 wherein the first elastic apparatus is a linear spring arm.

14. The media-conveying apparatus of claim 1 wherein the printer has a paper outlet, and a rolling apparatus disposed below the star-wheel for driving the printing media to the outlet.

* * * * *